US007428871B2

(12) United States Patent
Dodson et al.

(10) Patent No.: US 7,428,871 B2
(45) Date of Patent: Sep. 30, 2008

(54) PELLET FOR PNEUMATIC AND SPRING-PISTON OPERATED WEAPONS

(76) Inventors: L. Carl Dodson, 259 Kellogg St., Delta, CO (US) 81416; David Phillips, 472 S. Water St., Sheridan, WY (US) 82801

( * ) Notice: Subject to any disclaimer, the term of this patent is extended or adjusted under 35 U.S.C. 154(b) by 56 days.

(21) Appl. No.: 11/483,579

(22) Filed: Jul. 10, 2006

(65) Prior Publication Data

US 2007/0006769 A1 Jan. 11, 2007

Related U.S. Application Data

(60) Provisional application No. 60/697,755, filed on Jul. 8, 2005.

(51) Int. Cl.
*F42B 10/00* (2006.01)

(52) U.S. Cl. ..... 102/502; 102/501; 102/439

(58) Field of Classification Search ..... 102/439, 102/501, 502, 508

See application file for complete search history.

(56) References Cited

U.S. PATENT DOCUMENTS 4,005,660 A * 2/1977 Pichard ..... 102/501
5,275,108 A * 1/1994 Chernicky et al. ..... 102/439
5,471,719 A * 12/1995 Sawyers ..... 86/54
5,528,989 A * 6/1996 Briese ..... 102/506
5,760,331 A * 6/1998 Lowden et al. ..... 102/506
6,244,186 B1 * 6/2001 Pichard ..... 102/508
6,629,485 B2 * 10/2003 Vaughn et al. ..... 86/55
6,837,165 B2 * 1/2005 Eberhart et al. ..... 102/510
2002/0100389 A1 * 8/2002 May et al. ..... 102/501

FOREIGN PATENT DOCUMENTS

GB 2269654 A * 2/1994
GB 2279440 A * 1/1995

OTHER PUBLICATIONS

Beeman Air Gun Pellet Specifications (Date: Dec. 17, 2002) Using Wayback Machine from http://web.archive.org/web/20021217115316/http://www.beemans.net/pellet+specs.htm□□http://web.archive.org/web/*/http://www.beemans.net/pellet%20specs.htm.*
www.beemans.net/pellet%20specs.htm.
www.beemans.net/image/RDB-in-Webley-ad.gif.

* cited by examiner

*Primary Examiner*—Michael J. Carone
*Assistant Examiner*—Michael D David
(74) *Attorney, Agent, or Firm*—James Ray & Assoc.

(57) ABSTRACT

A pellet for at least one of a compressed gas and spring operated weapon includes a forward head portion and a cylindrical rearward tail portion which is disposed about a common centerline with the head portion and which has an air pocket formed therein. A frustoconical middle portion connects the tail portion to the head portion. The pellet design is adaptable for use with various commonly available caliber weapons.

8 Claims, 1 Drawing Sheet

PELLET FOR PNEUMATIC AND SPRING-PISTON OPERATED WEAPONS

CROSS-REFERENCE TO RELATED APPLICATIONS

This application is related to and claims priory from Provisional Patent Application Ser. No. 60/697,755 filed Jul. 8, 2005.

FIELD OF THE INVENTION

The present invention relates, in general, to ammunition and, more particularly, this invention relates to a pellet for a pneumatic or spring-piston operated weapon, such as a pistol, gun, rifle and the like.

BACKGROUND OF THE INVENTION

As is generally well known, presently available pellets for a pneumatic or spring-piston operated weapon includes a tapered skirt portion with an air pocket and a head portion which is tapered for attachment to a smaller diameter end of such tapered skirt portion, forming what is commonly known as a diabolo pellet. The forward end of the head portion can be flat, rounded, hollow or pointed and is usually sized to fit the barrel bore.

The pellets are manufactured in different weights and sizes and are generally classified by their caliber. The most commonly used calibers include 0.177, 0.20, 0.22, 0.25 and their metric equivalents. The 0.177 caliber pellets are used for general shooting as well as for bulls eye target shooting. They offer the highest velocity for a given amount of air gun energy, and result in the flattest trajectory. The 0.22 caliber pellets are popular for hunting and pest control.

One disadvantage of the presently available prior art pellets is that the tapered skirt has a generally thin wall due to inclusion of the air pocket and bends easily under general field use, at times, prior to loading into the weapon. Another disadvantage of the presently available prior art pellet is that the tapered tail portion, often adapted with longitudinal ridges or grooves, facilitates air leaks during travel through the barrel bore which decreases the shooting accuracy. Yet, another disadvantage is that the prior art pellets made to fit a standard Imperial size barrel bore will not fit corresponding equivalent Metric size barrel bore.

SUMMARY OF THE INVENTION

The invention overcomes disadvantages of the presently available pellets for a compressed gas and spring operated weapon having a barrel bore through which the pellet travels and discharges by providing a pellet which includes a forward head portion. A cylindrical rearward tail portion is disposed about a common centerline with the head portion. An air pocket is formed within the tail portion. A middle portion connects the tail portion to the head portion.

OBJECTS OF THE INVENTION

It is, therefore, one of the primary objects of the present invention to provide a pellet for air or gas operated weapons.

Another object of the present invention is to provide a pellet which does not deform during use.

Yet another object of the present invention is to provide a pellet which incorporates a generally cylindrical tail portion for improving rigidity of the tail section.

A further object of the present invention is to provide a pellet which has a low coefficient of friction.

Yet a further object of the present invention is to provide a pellet that travels at higher velocity than presently available pellets.

Additional object of the present invention is to provide a pellet that interchangeably fits Imperial and Metric equivalent size barrel bores.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
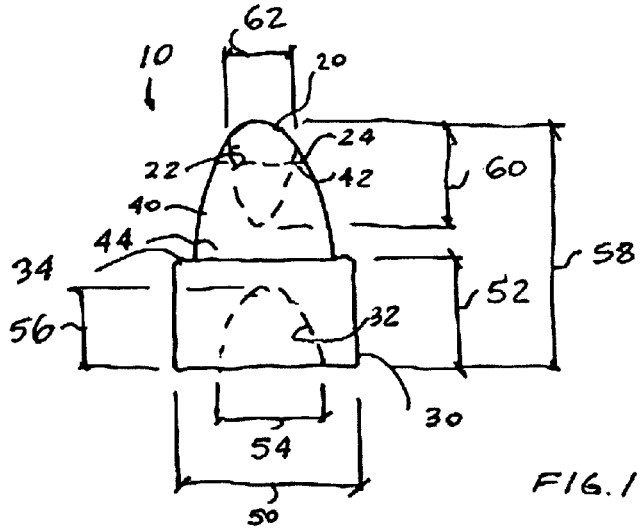
FIG. 1 is an side elevation view of a pellet of a presently preferred embodiment of the invention for use with pneumatic or spring-piston operated weapons.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of a weapon applies to guns, rifles, pistols and the like. Furthermore, the definition of a pneumatic weapon applies to air and gas operated weapons, either of a single stroke or multi stroke types.

Figure 2A:
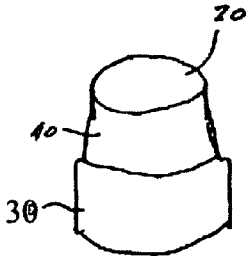
FIGS. 2*a*-2*d* illustrate various types of a head portion of the pellet of FIG. 1.
Figure 2B:
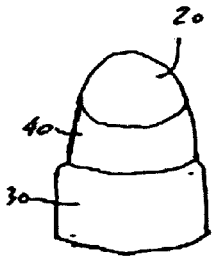
Figure 2C:
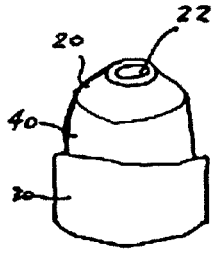
Figure 2D:
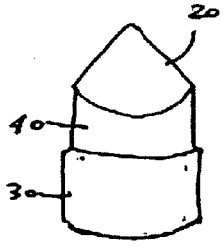

Reference is now made, to FIGS. 1-2*d*, wherein there is shown a pellet, generally designated 10, for one of a pneumatic and spring-piston operated weapon (not shown) having a barrel bore (not shown) through which the pallet 10 travels and discharges. The pellet 10 includes a forward head portion 20 which can be one of flat, round and pointed, as best shown in FIGS. 2*a*, 2*b*, and 2*d* respectively. In the presently preferred embodiment of the invention, the head portion 20 is round. It may be further adapted with an axial V-shaped or cup-shaped cavity 22, forming a hollow point head portion 20.

Another essential element of the invention is a cylindrical rearward tail portion 30 which is disposed about a common centerline with the head portion 20. There is a V-shaped or cup-shaped cavity 32, formed within the tail portion 30, which functions as an air pocket. An outer diameter of the tail portion 30 is preselected to form a predetermined clearance with such barrel bore (not shown). The cylindrical shape of the tail portion 30 is advantageous for centering the pellet 10 within the barrel bore, for achieving an improved seal and for providing stability during travel.

Furthermore, the rigid wall formed by the cylindrical tail portion 30 and the cavity 32 maintains its shape during field use and will not collapse as rear skirt portions of the prior art pellets. The presently preferred tail portion 30 has a generally smooth outer surface.

A final essential element of the present invention is a middle portion 40 which connects the tail portion 30 to the head portion 20. The middle portion 40 has a frustoconical shape with a smaller end 42 connected to an end 24 of the head portion 20 and with a larger end 44 connected to the tail portion 30. Such frustoconical shape may be further adapted with a curved surface to emulate the shape of the round head portion 20 of the presently preferred embodiment of the invention. If required for a specific mold design, the diameter of the larger end 44 may be made smaller than the diameter of the tail portion 30 thus forming a ledge 34.

It is further preferred that the end 24 of the head portion 20, which is connected to the end 42 of the middle portion 40, has a round shape and a diameter of the end 24 is smaller than a diameter 50 of the tail portion 30.

The preferred material for pellet 10 is lead enabling it to be formed as a unitary member by a swaging process. Alternatively, the pellet 10 may be made from elastic plastic materials such as poly-tetra-fluoro-ethylene (PTFE), Teflon. Registered Trademark (RTM) and Nylon. RTM, brass and various combinations thereof.

When the pellet 10 is manufactured from lead material, a lubricant, such as liquid bullet lube manufactured by Lee Precision, Inc of Hartford, Wis., may be applied to an outer surface of at least one of the tail portion 30, the middle portion 40 and the head portion 20 for sealing such outer surface and for increasing the velocity of pellet 10.

The exemplary lead pellet 10 of the presently preferred embodiment for use with a 0.22 caliber weapon will have a diameter 50 of the tail portion 30 of between about 0.216 inches and about 0.217 inches and a length 52 of the tail section 30 of about 0.116 inches. The air pocket 32 has a diameter 54 of about 0.117 inches and a depth 56 of about 0.110 inches. The overall length 58 of the pellet 10 is about 0.269 inches.

When the pellet 10 is adapted with a hollow point head portion 20 of FIG. 2*c*, the diameter 62 of a peripheral edge of the cavity 22 is about 0.075 inches and a length 60 of cavity 22 is about 0.110 inches extending such cavity 22 into the middle portion 40. The weight of the pellet 10 formed according to the above sizes is between about 15-grain (0.97 g) and about 16-grain (1.04 g).

It was found during testing that such pellet 10 offers improved performance over prior art conventional pellets. Particularly, when tested using the RSW 48 Magnum, Crosman Model 140 and Benjamin 22 Caliber air guns, the velocity of the pellet 10 of the present invention was measured at about 1017 feet per second (fps), while the speed of the prior art conventional pellet was measured at about 900 fps. Velocity was measured with, a Master Chrony F-1 chronograph manufactured by Shooting Chrony, Inc of Amherst, N.Y.

It was further found that the diameter 50 of the tail portion of between about 0.216 inches and about 0.217 is advantageous for using the pellet 10 in weapons having a Metric size barrel bore of 5.5 mm. Accordingly, the pellet 10 of the above described exemplary construction is easily interchangeable between Imperial and Metric size barrel bores, thus solving the interchangeability problem of prior art pellets.

It was additionally found that the shooting accuracy using the pellet 10 of the present invention was also improved.

The exemplary lead pellet 10 of the presently preferred embodiment for a 0.177 or 4.5 mm caliber weapon has a diameter 50 of the tail portion 30 between about 0.175 inches and about 0.176 inches, overall length 58 of about 0.202 inches and weight of between about 7.6-grain (0.49 g) and about 8.6-grain (0.56 g). During testing, such pellet outperformed prior art 0.177 caliber pellets. The velocity of the pellet 10 for a 0.177 caliber weapon was measured at about 1200 fps using the Master Chrony F-1 chronograph.

Although the present invention has been shown in terms of the pellet for use with 0.177 or 0.22 caliber weapons which are most commonly used, it will be apparent to those skilled in the art, that the present invention may be applied to other calibers, such as 0.20, 0.25, 9 mm, 0.38 and the like.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. In combination with at least one of a 0.22 caliber compressed gas and spring operated weapon having a barrel bore through which a unitary pellet travels and discharges, said unitary pellet comprising:

(a) a forward head portion;

(b) a cylindrical rearward tail portion disposed about a common centerline with said head portion, said tail portion having a first end and an opposed second end, wherein a diameter of said tail portion is between about 0.216 inches and about 0.217 inches;

(c) a concave cavity formed within said tail portion in open communication with said first end thereof;

(d) a frustoconical middle portion having a first end thereof connected to said second end of said tail portion and having a second end thereof connected to said head portion, said middle portion further having a convex outer surface;

(e) a ledge formed by said first end of said middle portion having a diameter equal to the rearmost part of said tail portion, said ledge diameter being uniform from said first end of said middle portion to said rearmost part of said tail portion; and (f) wherein said pellet is manufactured from a lead material and wherein a weight thereof is between about 15-grain and about 16-grain.

2. The pellet, according to claim 1, wherein said pellet includes a lubricant applied to and sealing an outer surface of at least one of said tail portion, said middle portion and said head portion.

3. The pellet, according to claim 1, wherein said head portion is one of round, flat and pointed.

4. The pellet, according to claim 1, wherein one end of said head portion connected to said middle portion has a round shape and wherein a diameter of said one end is smaller than a diameter of said tail portion.

5. The pellet, according to claim 1, wherein an outer diameter of said tail portion is preselected to form a predetermined clearance with such barrel bore.

6. The pellet, according to claim 1, wherein said tail portion centers said pellet within such barrel bore.

7. The pellet, according to claim 1, wherein said pellet is formed as a unitary member by a swaging process.

8. In combination with at least one of a 0.177 caliber compressed gas and spring operated weapon having a barrel bore through which a unitary pellet travels and discharges, said unitary pellet comprising:

(a) a round forward head portion;

(b) a cylindrical rearward tail portion disposed about a common centerline with said head portion, said tail portion having a first end and an opposed second end, wherein a diameter of said tail portion is between about 0.175 inches and about 0.176 inches;

(c) a concave cavity formed within said tail portion in open communication with said first end thereof;

(d) a frustoconical middle portion having a first end thereof connected to said second end of said tail portion and having a second end thereof connected to said head portion, said middle portion further having a convex outer surface;

(e) a ledge formed by said first end of said middle portion having a diameter equal to the rearmost part of said tail portion, said ledge diameter being uniform from said first end of said middle portion to said rearmost part of said tail portion; and (f) wherein said pellet is manufactured from a lead material and wherein a weight thereof is between about 7.6-grain and about 8.6-grain.

* * * * *